US010488023B1

(12) United States Patent
Rao

(10) Patent No.: US 10,488,023 B1
(45) Date of Patent: Nov. 26, 2019

(54) LIGHTING SYSTEM CONFIGURED FOR MOUNTING WITH A CEILING SUPPORT GRID AND METHOD OF MOUNTING

(71) Applicant: Litetronics International, Inc., Bedford Park, IL (US)

(72) Inventor: Raghu Rao, Romeoville, IL (US)

(73) Assignee: Litetronics International, Inc., Bedford Park, IL (US)

( * ) Notice: Subject to any disclaimer, the term of this patent is extended or adjusted under 35 U.S.C. 154(b) by 0 days.

(21) Appl. No.: 16/370,386

(22) Filed: Mar. 29, 2019

(51) Int. Cl.
*F21V 21/04* (2006.01)
*F21S 8/02* (2006.01)

(52) U.S. Cl.
CPC ..... *F21V 21/048* (2013.01); *F21S 8/026* (2013.01)

(58) Field of Classification Search
CPC ..... F21S 8/026; F21V 21/048
See application file for complete search history.

(56) References Cited

U.S. PATENT DOCUMENTS

| | | | | |
|---|---|---|---|---|
| 8,393,765 | B2 | 3/2013 | Sugishita et al. | |
| 9,206,948 | B1 | 12/2015 | Scribante et al. | |
| 9,671,095 | B1 | 6/2017 | Sorensen et al. | |
| 9,897,288 | B2 | 2/2018 | Sorensen et al. | |
| 9,989,225 | B2 | 6/2018 | Rao et al. | |
| 10,161,579 | B2 | 12/2018 | Sorensen et al. | |
| 2013/0301249 | A1* | 11/2013 | Ngai | F21S 8/06 362/147 |

* cited by examiner

*Primary Examiner* — Thomas M Sember
(74) *Attorney, Agent, or Firm* — Witters & Associates; Steve Witters

(57) ABSTRACT

Technologies are described for a system for mounting a light source in a ceiling support grid. The lighting system has a first longitudinally extending support having a first light source holder and a longitudinal extending surface for lying on a first flange of the ceiling support grid A second longitudinally extending support has a second light source holder and a longitudinal extending surface for lying on a flange of the ceiling support grid parallel with the first flange. A rectangular or square light source is configured to be mounted with the longitudinally extending supports and in the ceiling support grid.

20 Claims, 10 Drawing Sheets

LIGHTING SYSTEM CONFIGURED FOR MOUNTING WITH A CEILING SUPPORT GRID AND METHOD OF MOUNTING

FIELD OF THE DISCLOSURE

This invention generally relates to a lighting system for mounting with a ceiling support and method of mounting a light source to a ceiling support grid.

BACKGROUND

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Ceiling support grids and ceiling panels are very common in the office buildings where ceilings are constructed over open floor plan interior designs, such as cubicles. Such ceiling are popular in other commercial, industrial and domestic environments, including and not limited to hotels, meeting rooms, recreation rooms and other types of rooms or constructions which require removable ceilings for access to utilities (heating, air conditioning, water) that are concealed in the space between the drop ceiling tiles and the structural ceiling of the room. Such ceiling systems are well suited for use in old office buildings with high ceilings and with ceilings that are curved or arched. Typically, ceiling panels may be installed from beneath the ceiling support grid.

It may be desired to mount, place, replace, install, or retrofit light sources in a ceiling support grid.

SUMMARY

In at least one embodiment of the present disclosure, a lighting system configured to be mounted with a ceiling support grid is provided. A first longitudinally extending support has a first light source holder and a longitudinal extending surface for lying on a first flange of the ceiling support grid. A second longitudinally extending support has a second light source holder and a longitudinal extending surface for lying on the third flange of the ceiling support grid. A rectangular or square light source is configured to be disposed in a rectangular or square grid opening in the ceiling support grid, the light source has a first end and a second end parallel with the first end. A first light source mount is proximate the first end of the light source and is configured and disposed to cooperate with the first light source holder, upon the first longitudinally extending support being laid on the first flange of the ceiling support grid. A second light source mount is proximate the second end of the light source and is configured and disposed to cooperate with the second light source holder, upon the second longitudinally extending support being laid on the third flange of the ceiling support grid. The cooperation of the first light source holder with the first light source mount and the cooperation of the second light source holder with the second light source mount holds the light source in the ceiling support grid. The first longitudinally extending support and the second longitudinally extending support are configured to resist rotation upon being laid on the ceiling support grid flanges.

BRIEF DESCRIPTIONS OF THE DRAWINGS

The foregoing and other features of this disclosure will become more fully apparent from the following description and appended claims, taken in conjunction with the accompanying drawings and examples. Understanding that these drawings depict only selected embodiments in accordance with the disclosure and are, therefore, not to be considered limiting of its scope. The specificity and detail of the present disclosure, through use of the following figures, are idealized, are not to scale, and are intended to be merely illustrative of aspects of the present disclosure and non-limiting. In the drawings, like elements may be depicted by like reference numerals. The drawings are briefly described as follows:

DETAILED DESCRIPTION

Figure 1:
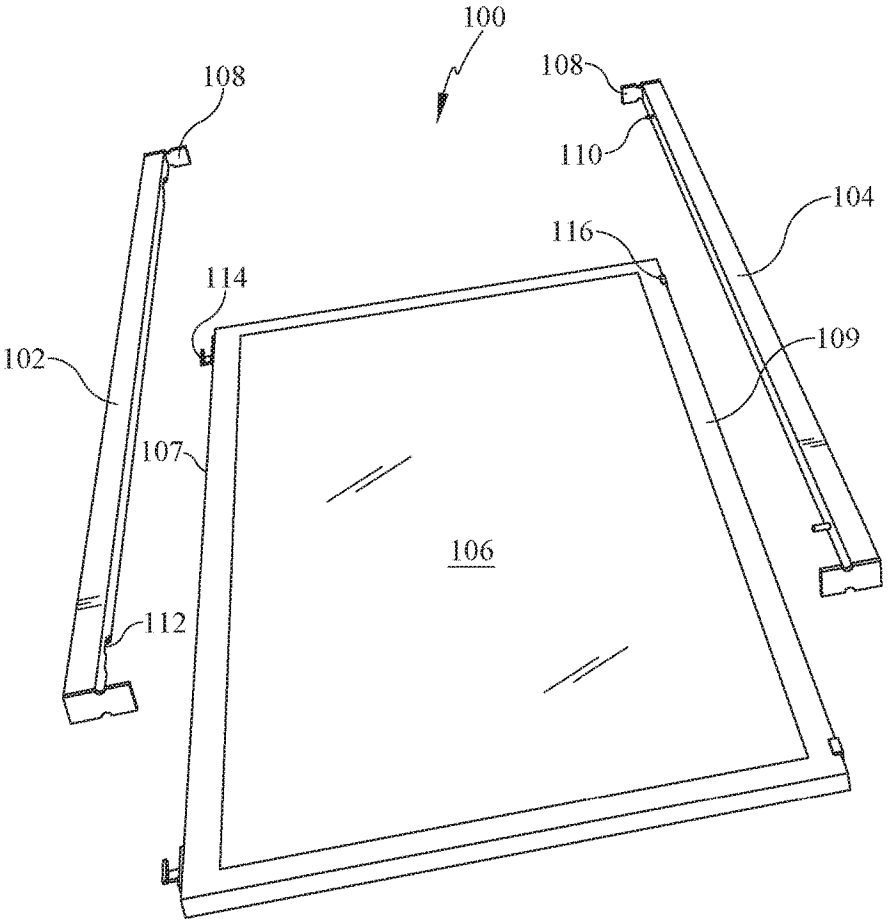
FIG. 1 is a perspective view of a lighting system configured to be mounted with a ceiling support grid.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

This present disclosure addresses issues associated with ceiling support grid systems, such as lighting systems. Presently disclosed is a system for mounting a rectangular or square light source, such as an LED light source, to a ceiling support grid. Longitudinally extending supports are configured to be inserted into a ceiling support grid opening and laid on the grid to provide for the mounting of a rectangular or square light source to the ceiling support grid. The longitudinally extending supports may be configured to resist rotation on the ceiling support grid for easing installation of the light source. The longitudinally extending supports may have slots, openings, or extensions configured for cooperation with, and mounting of, the light source. The lighting system of the present disclosure may be installed tool-lessly by placing longitudinally extending supports on the ceiling support grid and installing a light source with the longitudinally extending supports.

Embodiments of the present disclosure may provide light source that enables easy, or less laborious, tool-less installation, or retrofitting, of a light source. Typical luminaires installed in ceiling support grids, which may be retrofitted with the presently disclosed system, may have a troffer with one or more tube lamps held therein. The luminaire may be placed on the ceiling support grid to have the light from the lamps directed downward through a space in the ceiling support grid having a ceiling panel removed. A lens, such as a diffusing lens or diffuser, or louver may be placed about the light opening in the ceiling support grid.

Retrofitting an existing luminaire, such as a troffer, may be performed with the presently disclosed lighting system configured to be mounted with a ceiling support grid. The presently disclosed longitudinally extending supports may be configured to be inserted into a ceiling support grid opening and held thereon. For example, the longitudinally extending supports may be configured to fit between inwardly extending flanges of the ceiling support grid and a luminaire, ex. troffer, being retrofitted.

Upon installation of the longitudinally extending supports in the ceiling support grid opening, a light source may be installed. For example, one end portion of the light source may be configured to cooperate with one of the longitudinally extending supports and the opposite end portion of the light source may be configured to cooperate with the second longitudinally extending support. Wherein the cooperation of the first and second end portions of the light source with the first and second longitudinally extending supports holds the light source in the ceiling support grid. The first longitudinally extending support may have a first light source holder and the second longitudinally extending support may have a second light source holder. The first light source holder may be the same as, or different than, the second light source holder. For example, the light source may have one or more extension(s), clasps, or other features configured to cooperate with a light source holder on the longitudinally extending supports. In at least one embodiment, the light source has at least one extension configured and disposed to cooperate with an opening in a longitudinally extending support. In at least one other embodiment, the light source has at least one clasp configured and disposed to clasp onto an extension extending from a longitudinally extending support.

The light source of the present disclosure may have a low profile, enabling it fit into an existing troffer for retrofitting. For example, the light source may be in the form of a shallow troffer or planar panel or have other configurations. The light source may have LED lights or an array of LEDs.

In at least one embodiment of the present disclosure, the lighting system has a first longitudinally extending support having a first light source holder, for example openings or extensions, and a longitudinal extending surface for lying on the first flange of the ceiling support grid. A second longitudinally extending support has a second light source holder and a longitudinal extending surface for lying on the third flange of the ceiling support grid. The first and the third flanges being parallel. A rectangular or square light source is configured to be disposed in a rectangular or square grid opening in the ceiling support grid, the light source has a first end and a second end parallel with the first end. A first light source mount is proximate the first end of the light source configured and disposed to cooperate with the first light source holder, upon the first longitudinally extending support being laid on the first flange of the ceiling support grid. A second light source mount is proximate the second end of the light source configured and disposed to cooperate with the second light source holder, upon the second longitudinally extending support being laid on the third flange of the ceiling support grid.

FIG. 1 is a perspective view of an illustrative example of the presently disclosed lighting system 100 configured to be mounted with a ceiling support grid. A rectangular or square light source 106 is configured to fit into a rectangular or square opening in a ceiling support grid and be held therein with longitudinal extending supports 102 and 104. It is to be understood that the illustrative examples shown in the figures are not limiting the present disclosure.

Light source 106 may have end portions configured to cooperate with and be held by longitudinally extending supports. For example, light source 106 may have a first end 107 with a first light source mount. The first light source mount may have at least one extension 114 extending from light source 106. Light source 106 may have second end 109 with a second light source mount proximate therewith. The second light source mount may have at least one clasp 116 on light source 106.

A first longitudinally extending support 102 has a first light source holder. The first light source holder may have at least opening 112 therein. First longitudinally extending support has a longitudinal extending surface for lying on a flange of the ceiling support grid. Opening(s) 112 may be configured and disposed to cooperate with the extension(s) 114.

A second longitudinally extending support 104 has a second light source holder. The second light source holder may have at least one extension 110 extending outwardly from second longitudinally extending support 104. Second longitudinally extending support 104 has a longitudinal extending surface for lying on a flange of the ceiling support grid. Extension(s) 110 may be configured and disposed to cooperate with clasp(s) 116. Additional and alternative structures and means for cooperating the light source with the longitudinally extending supports known by persons having ordinary skill in the art and are within the scope of the present disclosure.

One or both longitudinally extending supports, 102 and 104, may have at least one anti-rotational stopper 108. Anti-rotational stopper(s) 108 may enable longitudinally extending supports 102 and/or 104 to resist rotation upon installation of light source 106 with longitudinally extending supports 102 and/or 104. The resistance of rotation of longitudinally extending supports 102 and/or 104 may ease attaching light source 106 to longitudinally extending supports 102 and/or 104 during installation.

Figure 2:
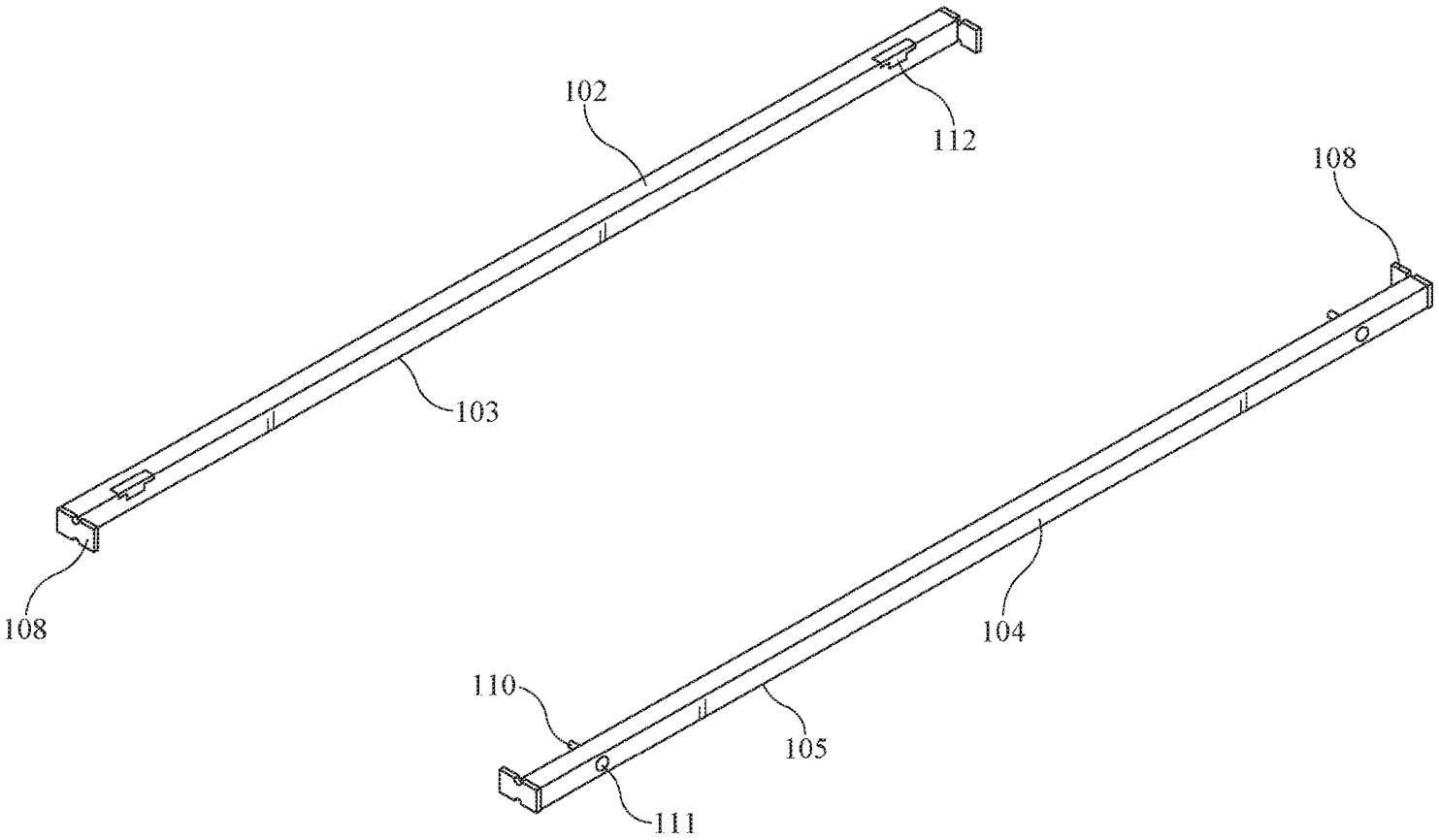
FIG. 2 is a perspective view of longitudinally extending supports shown in FIG. 1.

FIG. 2 is a perspective view of illustrative examples of longitudinally extending supports 102 and 104. First longitudinally extending support 102 has at least opening 112 therein and a longitudinal extending surface 103 for lying on a flange of a ceiling support grid. Opening(s) 112 may have a variety of configurations for cooperating with light source 106. For example, opening 112 may have an upper portion that is wider than a lower portion. This configuration may enable rectangular or square light source 106 to be hung from first longitudinally extending support 102 during installation.

Second longitudinally extending support 104 may have at least one extension 110 extending outwardly therefrom and a longitudinal extending surface 105 for lying on a flange of the ceiling support grid. Extension(s) 110 may extend from second longitudinally extending support 104 in a plane parallel with longitudinal extending surface 105. This configuration may position extension(s) 110 to extend into a square or rectangular opening in the ceiling support grid upon lying longitudinally extending support 104 on a flange of the ceiling support grid. This positioning of extension(s) 110 may dispose them for cooperation with clasp(s) 116 during installation.

At least one magnet 111 may be disposed on first 102 and/or second 104 longitudinal extending support. The at least one magnet 111 may be positioned to cooperate with an inward or upward extending flange of the ceiling support grid. For example, at least one magnet 111 may be disposed on, or perpendicularly with, longitudinally extending surface 103 and/or 105.

First and/or second longitudinally extending supports, 102 and/or 104, may have a variety of configurations. For example, first and/or second longitudinally extending supports, 102 and/or 104 may be made with flat material, such as a sheet of metal or polymeric, or extruded lengths of materials. First and/or second longitudinally extending supports, 102 and/or 104 may have open or hollow core or may be solid. First and/or second longitudinally extending supports, 102 and/or 104 may have a linear or flat cross-section, rounded or circular cross-section, or angular cross-section. In at least one embodiment, first and/or second longitudinally extending supports, 102 and/or 104, have a rectangular or square cross-section.

Figure 3:
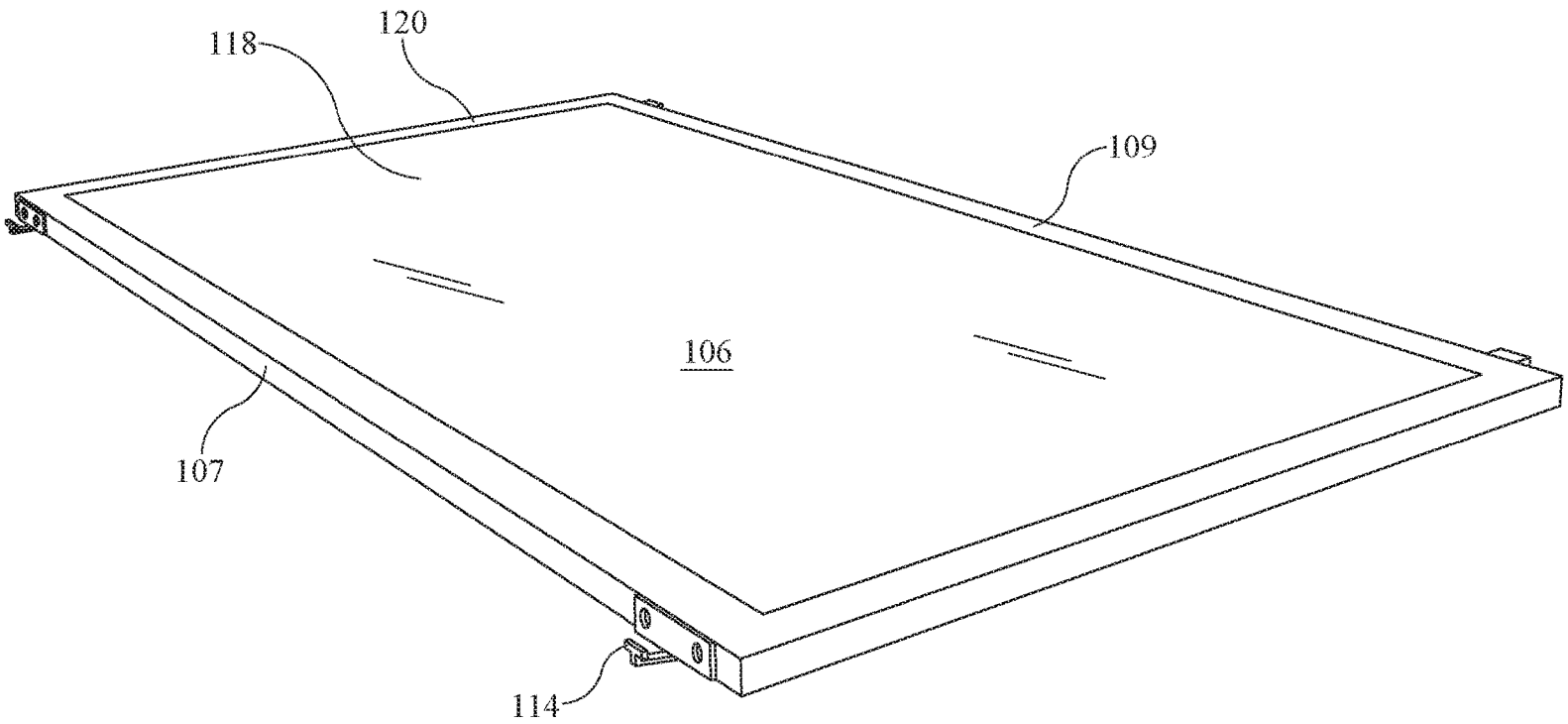
FIG. 3 is a perspective view of the light source shown in FIG. 1 showing at least one extension extending therefrom.

FIG. 3 is a perspective view of the light source 106 showing at least one extension 114 extending therefrom. Extension(s) 114 may be disposed on or proximate a first end 107 of light source 106. Extension 114 may be configured to be inserted into opening 112 in first longitudinally extending support 102 and hold light source 106 to first longitudinally extending support 102. In at least one embodiment, extension 114 may have a hook configuration and be disposed to hang light source 106 from first longitudinally extending support 102 and to pivot light source 106 about first longitudinally extending support 102. For example, extension 114 may have a curved or angled portion and/or a flared end.

Figure 4:
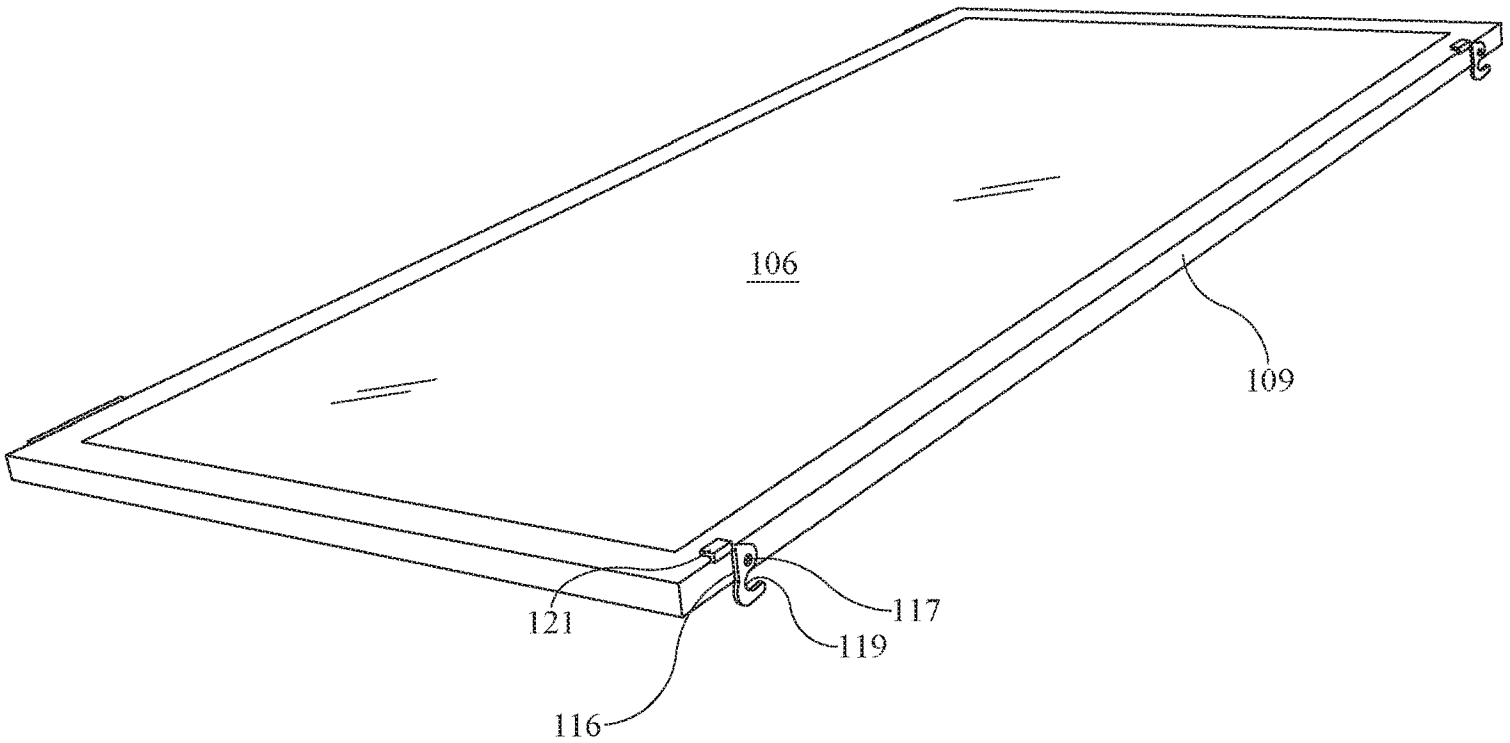
FIG. 4 is a perspective view of the light source shown in FIG. 1 showing at least one clasp on an end of the light source.

FIG. 4 is a perspective view of the light source 106 showing at least one clasp 116 on, or proximate with, second end 109 of light source 106. For example, clasp 116 may be rotatably attached, at aperture 117, to a second end 109 of light source 106. Clasp 116 may be configured and disposed to clasp on extension 110, extending from second longitudinally extending support 104, upon its rotation about aperture 117. For example, clasp 116 may have notch 119 configured and disposed to clasp and hold an extension 110. Clasp 116 may have a stop 121 configured and disposed to become substantially adjacent light source 106 upon clasping onto extension 110.

Figure 5:
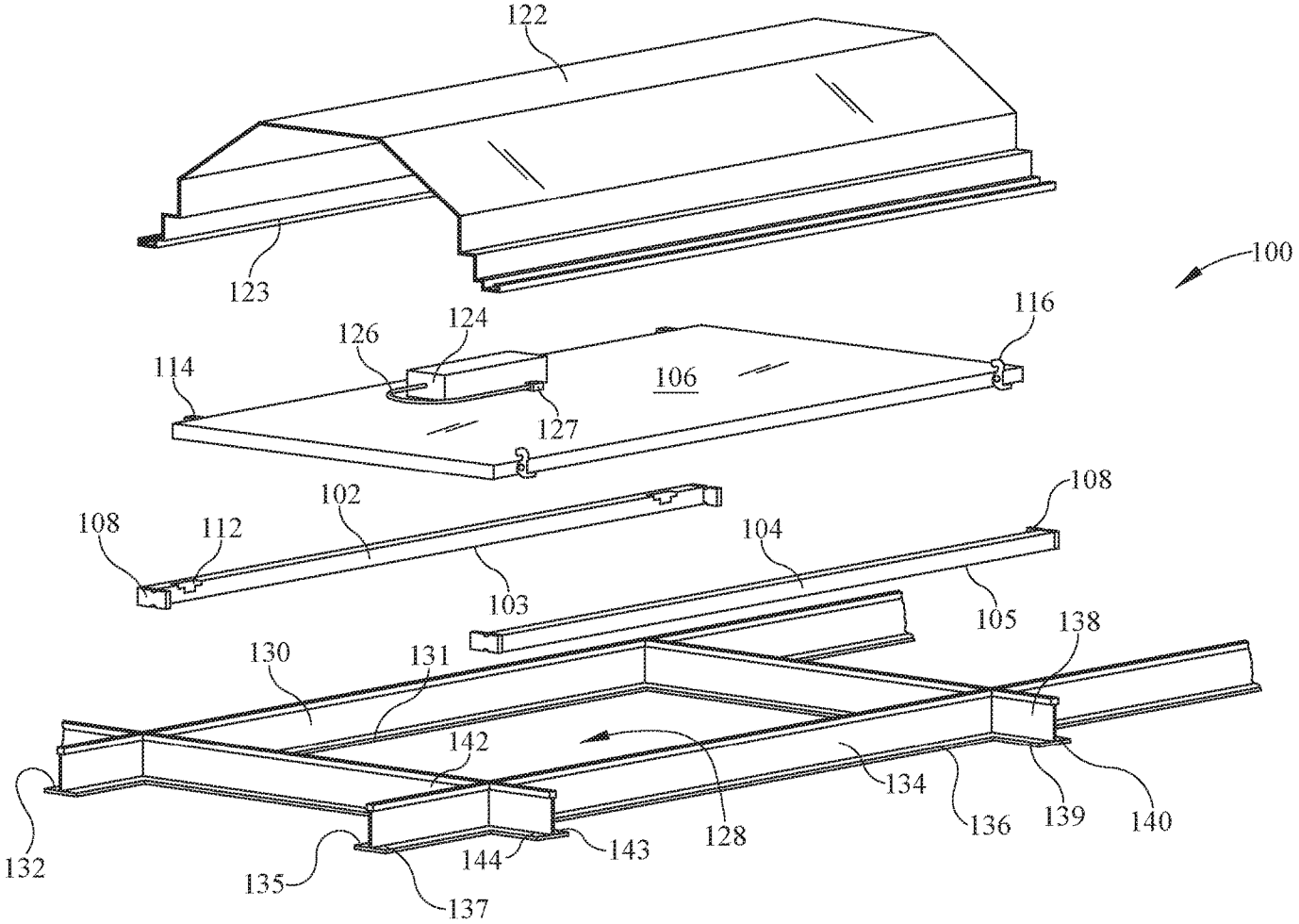
FIG. 5 is an exploded view of the lighting system shown in FIG. 1, a ceiling support grid, and an existing troffer.

FIG. 5 is an exploded view of the lighting system 100, a ceiling support grid, and an existing troffer 122. The ceiling support grid comprises at least one rectangular or square grid opening 128 with a first longitudinal flange 131 extending inward from a first side, a second longitudinal flange 143 extending inward from a second side, a third longitudinal flange 135 extending inward from a third side, and a fourth longitudinal flange 139 extending inward from a fourth side, wherein the first flange 131 is parallel with the third flange 135 and the second flange 143 is parallel with the fourth flange 139.

The ceiling support grid may have a "T" shaped cross section. For example, the ceiling support grid support may have a first side with inward extending flange 131, upward extending flange 130, and outward extending flange 132, a second side with inward extending flange 143, upward extending flange 142, and outward extending flange 144, a third side with inward extending flange 135, upward extending flange 134, and outward extending flange 136, and a fourth side with inward extending flange 139, upward extending flange 138, and outward extending flange 140.

Lighting system 100 is configured to be mounted with the ceiling support grid and may have a first longitudinally extending support 102 having at least opening 112 therein and a longitudinal extending surface 103 for lying on first flange 131 of the ceiling support grid. A second longitudinally extending support 104 may have at least one extension 110 extending outwardly therefrom and a longitudinal extending surface 105 for lying on third flange 135 of the ceiling support grid.

Rectangular or square light source 106 is configured to be disposed in a rectangular or square grid opening 128 in the ceiling support grid, defined by the inward extending flanges. Light source 106 has a first end 107 and a second end 109, second end 109 being parallel with first end 107. At least one extension may 114 extend from proximate first end 107 of light source 106 and may be configured and disposed to extend into opening 112 in first longitudinally extending support 102, upon first longitudinally extending support 102 being laid on first flange 131 of the ceiling support grid.

At least one clasp 116 may be on or proximate second end 109 of light source 106 and may be configured and disposed to clasp an extension 110 extending outwardly from second longitudinally extending support 104, upon second longitudinally extending support being laid on third flange 135, of the ceiling support grid.

First longitudinally extending support 102 and second longitudinally extending support 104 are configured to resist rotation upon being laid on the ceiling support grid flanges. For example, the longitudinal extending surfaces 103 and 105 of the longitudinally extending supports 102 and 104 configured for lying on the flanges of the ceiling support grid may be flat surfaces. In at least one embodiment, first longitudinally extending support 102 is longer than first end 107 of light source 106 and/or second longitudinally extending support 104 is longer than second end 109 of light source 106. For example, first longitudinally extending support 102 and/or second longitudinally extending support 104 may be configured to extend onto second inwardly extending flange 143 and/or fourth inwardly extending flange 139, of the ceiling support grid.

Lighting system 100 may have at least one anti-rotational stopper 108 on at least one of longitudinally extending supports 102 and 104. Anti-rotational stopper 108 may be configured and disposed to cooperate with second flange 143 or fourth flange 139 of the ceiling support grid.

At least one magnet 111 may be on at least one of first 102 and second 104 longitudinally extending supports. The at least one magnet 111 is configured and disposed to magnetically interact with the ceiling support grid, upon the at least one of the first 102 and the second 104 longitudinally extending support being laid on the ceiling support grid. For example, at least one magnet 111 may extend vertically or parallel with the longitudinal extending surface of the longitudinally extending support. In at least one embodiment, at least one magnet extends vertically with the longitudinal extending surface of the longitudinally extending support, as shown in FIG. 2.

Lighting system 100 may be configured to retrofit an existing luminaire such as troffer light source 122. For example, first longitudinally extending support 102 may be configured to fit between existing troffer 122 and first flange 131 of the ceiling support grid and second longitudinally extending support 104 may be configured to fit between existing troffer 122 and third flange 135 of ceiling support grid. Light source 106 may be configured to fit in or below existing troffer 122, for example light source 106 may be a shallow troffer, panel light, or have another configuration.

Lighting system 100 may comprise an electrical driver 124 which may be configured to be mounted proximate to, or on, light source 106. A cord 126 may be in electrical communication with electrical driver 124 which may have an electrical connector 127, such as a quick connect. Electrical cord 126 may be coilable and/or electrical driver 124 may be configured to be magnetically mountable and may be magnetically mounted on the non-light emitting side of light source 106. A magnetically mountable electrical driver 124 may also be mounted proximate light source 106, for example in troffer 122 being retrofitted with the presently disclosed lighting system.

Figure 6:
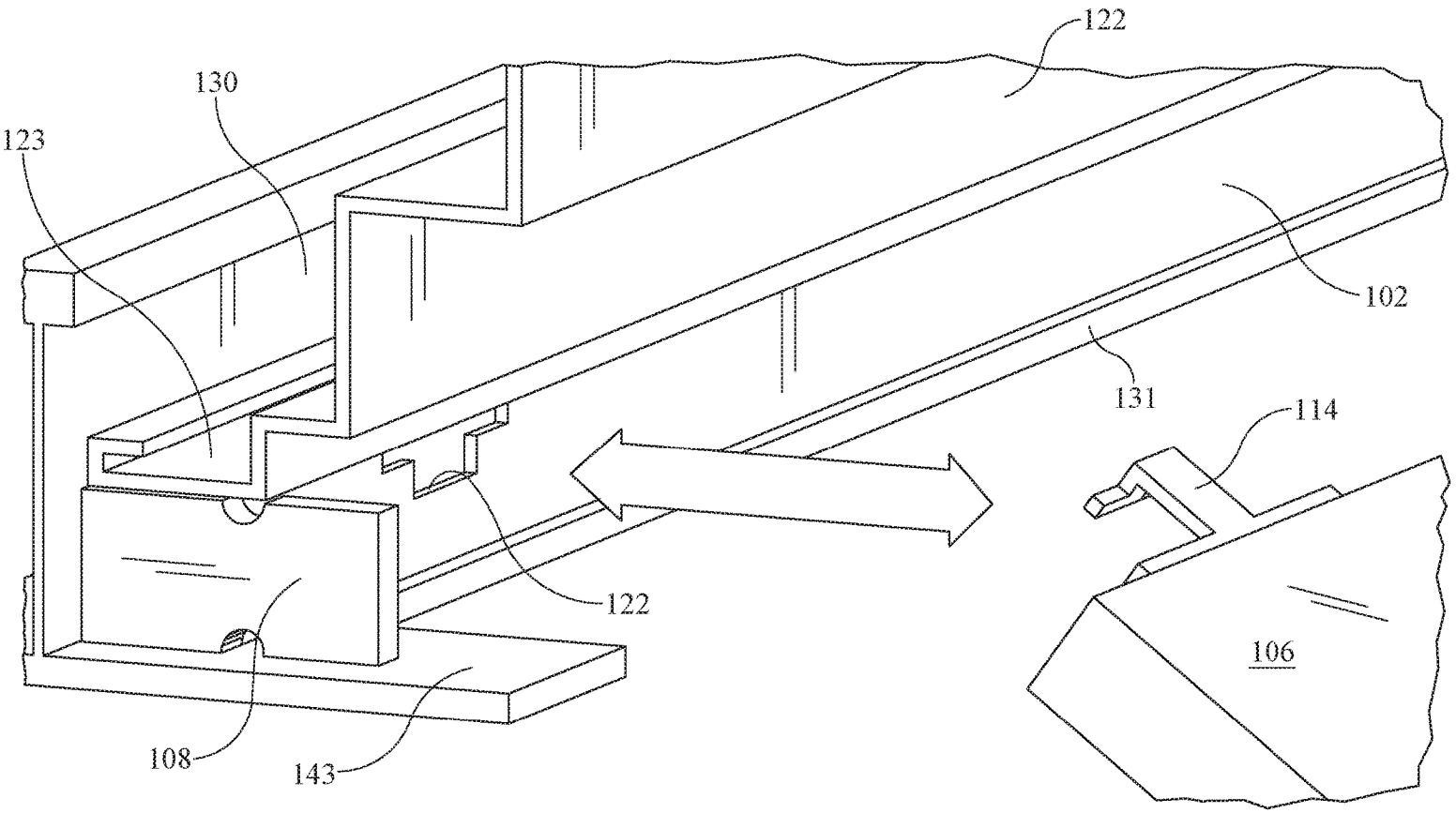
FIG. 6 is a cut-away portion of a first end of the lighting system in FIG. 1 showing cooperation of the lighting system shown in FIG. 1, a ceiling support grid, and an existing troffer being retrofitted.

FIG. 6 is a cut-away portion of a first end of lighting system 100 showing cooperation of lighting system 100, a ceiling support grid, and existing troffer 122 being retrofitted. In this embodiment, first longitudinally extending support 102 is laid on inward extending flange 131 and has opening 112 disposed to receive extension 114. The length of longitudinally extending support 102 may be longer than light source 106 and extend onto second flange 143. Anti-rotational stopper 108 may be disposed on one or both ends of longitudinally extending support 102. Anti-rotational stopper 108 may extend outward from longitudinally extending support 102 and onto second inward extending flange 143.

Longitudinally extending support 102 may have a linear, rounded, angular, rectangular or square cross-section and may have an upper surface for supporting troffer 122 being retrofitted. Longitudinally extending support 102 may be configured to receive extension 114, extending from light source 106, and avoid interference of extension 114 with the ceiling support grid and troffer 122 upon mounting light source with the ceiling support grid.

Figure 7:
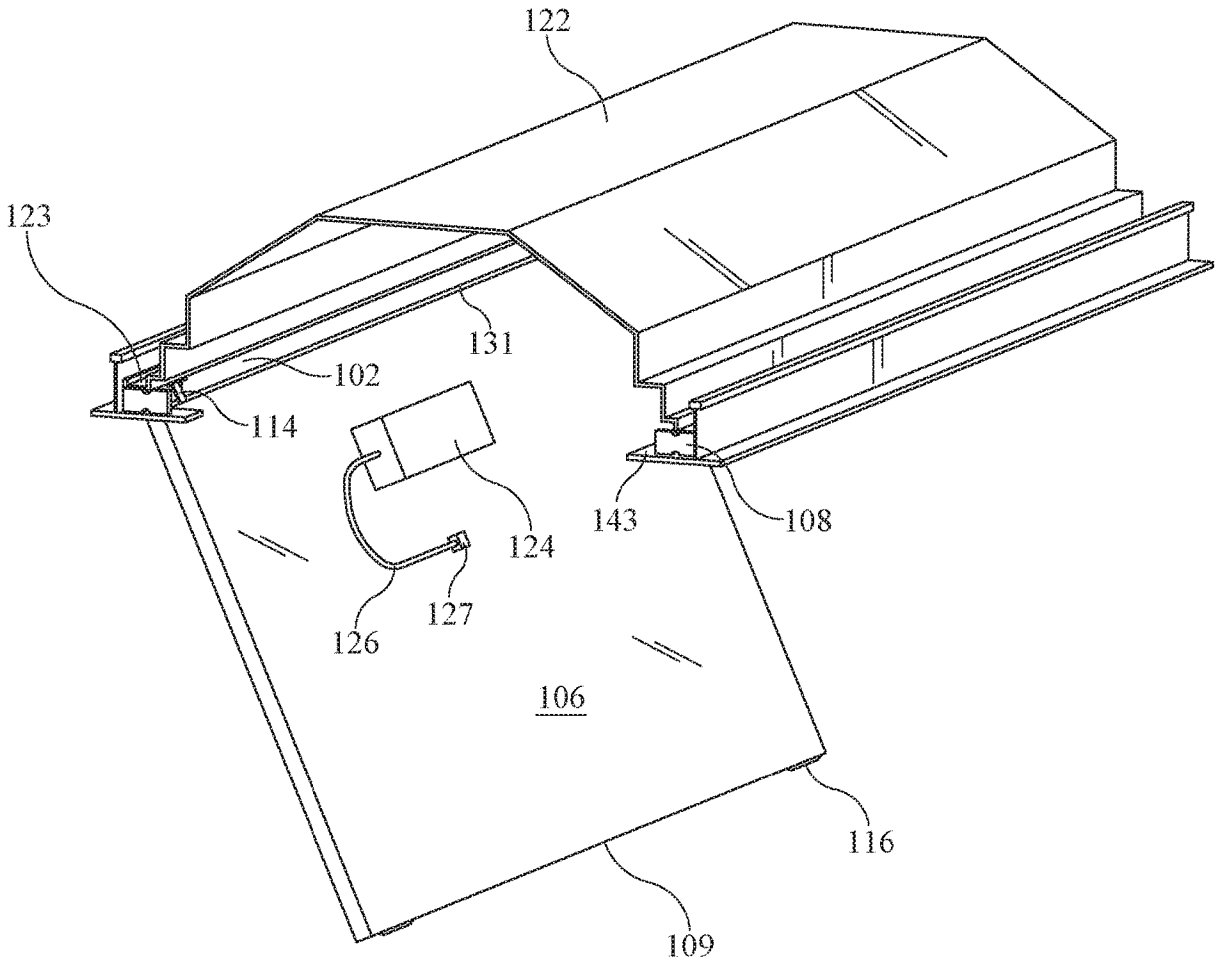
FIG. 7 is an upper perspective view of the lighting system in FIG. 1 showing retrofitting an existing troffer in a ceiling support grid.

FIG. 7 is an upper perspective view of lighting system 100 showing retrofitting an existing troffer 122 in a ceiling support grid. Upon insertion of first longitudinally extending support 102 between troffer 122 and flange 131, light source 106 may be hung from first longitudinal extending support 102. For example, extension 114 may be configured to be held in opening 112 and hingedly cooperate with first longitudinally extending support 102.

Figure 8:
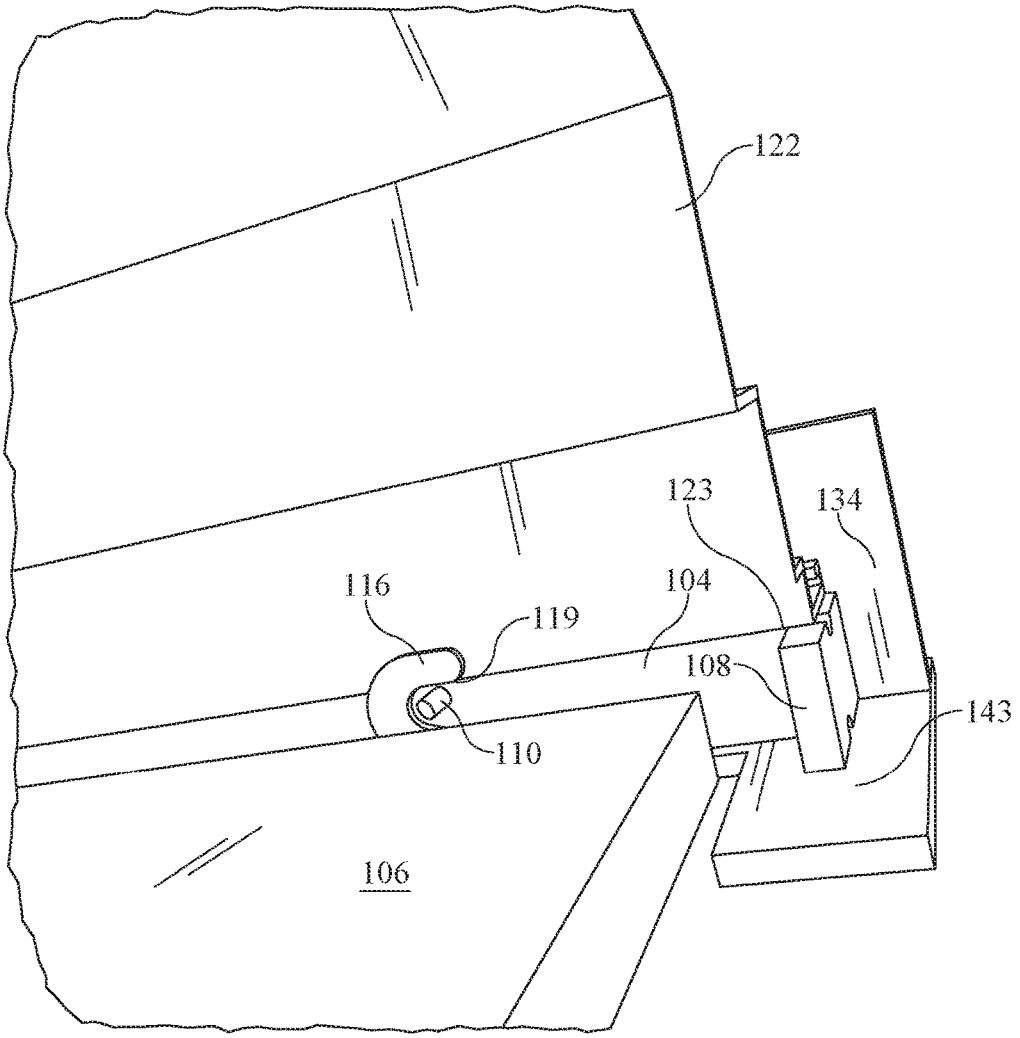
FIG. 8 is a cut-away portion of a second end of the lighting system in FIG. 1 showing cooperation of the lighting system shown in FIG. 1, a ceiling support grid, and an existing troffer being retrofitted.

FIG. 8 shows an upper cut-away portion of lighting system 100 illustrating cooperation of lighting system 100, the ceiling support grid, and existing troffer 122 being retrofitted. In at least one embodiment, light source 106 is configured to be rotated about its first end 107, upon being held with first longitudinally extending support 102 as shown in FIGS. 6 and 7, and inserted into rectangular or square grid opening 128. Upon insertion of light source 106 into ceiling support grid opening 128, second end 109 of light source 106 becomes proximate second longitudinal extending support 104 and clasp 116 becomes positioned to cooperate with an extension 110. Rotation of clasp 116 about aperture 117, wherein clasp 116 is rotatably held at aperture 117, clasp 116 clasps onto extension 110 and holds light source 106 in the ceiling support grid. In at least one embodiment, clasp 116 may be rotated by pushing stop 121 to become substantially adjacent light source 106, clasping onto extension 110.

Figure 9:
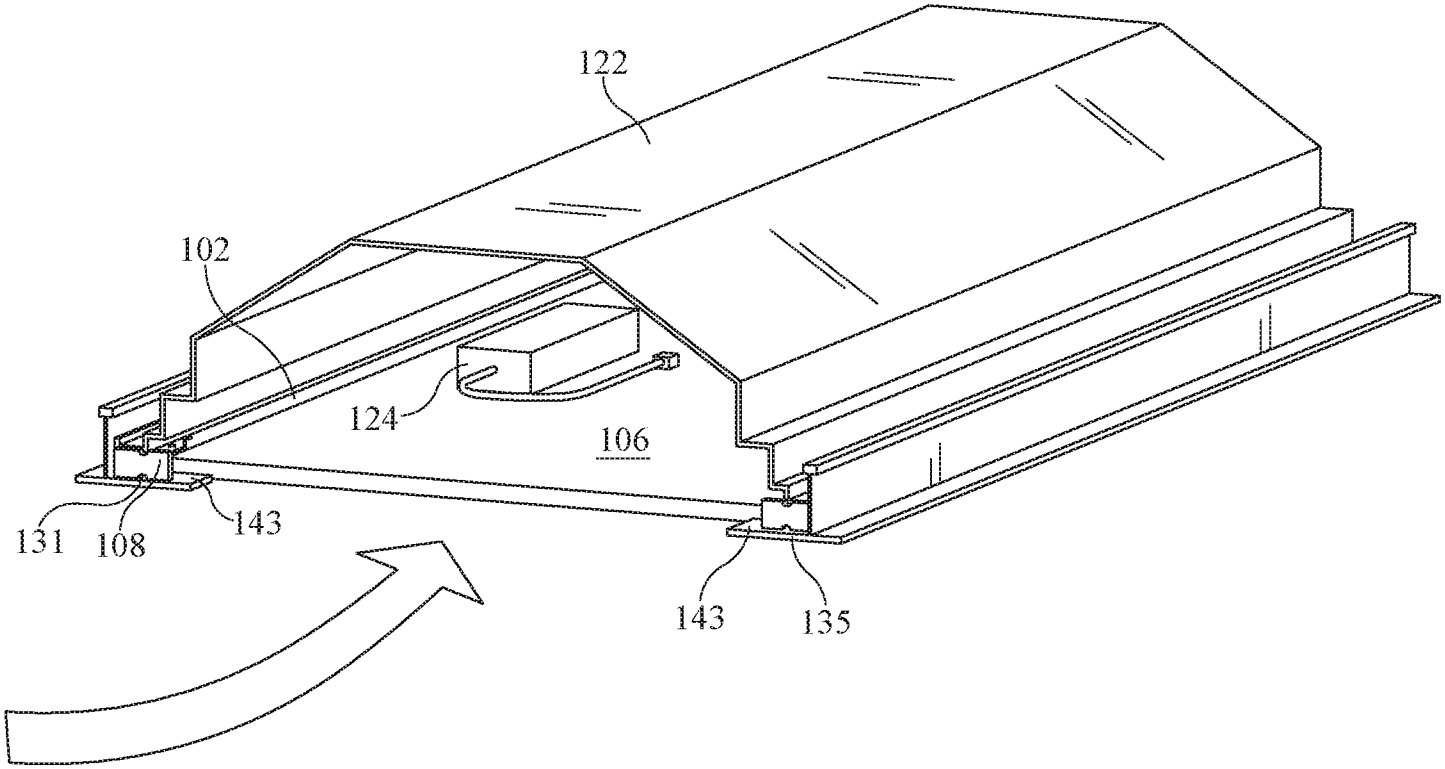
FIG. 9 shows the lighting system shown in FIG. 1 installed in a ceiling support grid and retrofitting an existing luminaire.

FIG. 9 shows the lighting system 100 installed in a ceiling support grid and retrofitting an existing luminaire having a troffer 122. Light source 106 is held in a plane of the ceiling support grid with first longitudinal extending support 102 and second longitudinally extending support 104. Light source 106 may have an LED light panel or other shallow configuration. Driver 124 may be held on light source 106 or proximate therewith. For example, driver 124 may be held on troffer 122.

First longitudinally extending support 102 may rest on first flange 131 and may extend onto adjacent inward extending flanges. For example, first longitudinally extending support 102 may extend onto inward extending flange 143. Anti-rotational stop 108 may extend from an end of first longitudinally extending support 102 and onto inward extending flange 143.

Second longitudinally extending support 104 may rest on first flange 135 and may extend onto adjacent inward extending flanges. For example, second longitudinally extending support 104 may extend onto inward extending flange 143. Anti-rotational stop 108 may extend from an end of second longitudinally extending support 102 and onto inward extending flange 143.

First longitudinally extending support 102 and second longitudinally extending support 104 may hold troffer 122 thereon. Extension(s) 114 may extend into opening(s) 112, in first longitudinally extending support 104 and hold first end 107 of light panel 106. Clasp(s) 116 may clasp onto extension 110, extending from second longitudinally extending support 104, and hold second end 109 of light panel 106.

Figure 10:
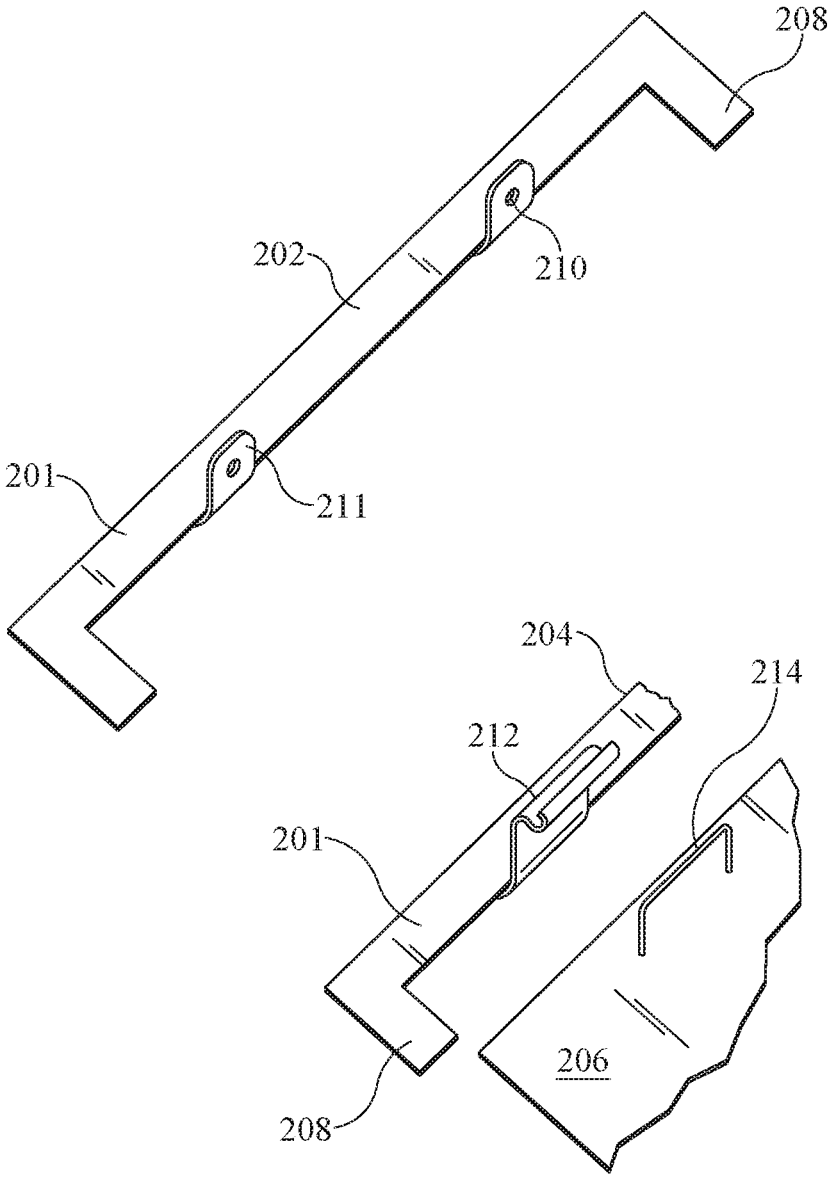
FIG. 10 shows other embodiments of elements of the presently disclosed lighting system configured to be mounted with a ceiling support grid.

Alternative or additional structures or components of the presently disclosed lighting system configured to be installed in a ceiling support grid that may become known by persons having ordinary skill in the art upon reading the present disclosure and are within the scope of the present claims. FIG. 10 illustrates examples of embodiments of elements of the presently disclosed lighting system configured to be mounted with a ceiling support grid.

Longitudinal extending support 202 may have a flat length 201 with a linear cross-section for lying on a ceiling support flange. Anti-rotational stoppers 208 may extend from, and in a plane with, flat length 201. Anti-rotational stoppers 208 may be configured and disposed to lay on flanges of the ceiling support grid that are perpendicular to the flange of the ceiling support grid that flat length 201 lays upon.

A light source holder may have one or more tabs or extensions 211 that may extend from length 201 and may be configured for holding an end portion of a light source. The one or more tabs or extensions 211 may have a shape or a mounting feature, such as mounting feature 210, for mounting or installing a light source. For example, mounting feature 210 may be an aperture, an extension such as a post like extension, or other feature for mounting and holding a light source. Longitudinal extending support 204 shows a light source holder that has tabs or extensions 212 having a shape for mounting a light source. For example, tabs or extensions 212 may have a channel shaped portion configured and disposed to mount with a light source mount. For example light source mount 214 may be configured and disposed to mount with light source holder 212.

A method of installing a light source in a ceiling support grid is presently disclosed. In at least one embodiment of the presently disclosed method, a light source may be tool-lessly installed in a ceiling support grid. For example, a first longitudinally extending support is laid on a first flange of a ceiling support grid. A second longitudinally extending support is laid on a flange of a ceiling support grid parallel with the first flange. If an existing luminaire is being retrofitted, then the first and second longitudinally extending supports may be placed between the existing luminaire and the ceiling support grid. For example, a troffer may be supported with the first and second longitudinally extending supports.

A first light source mount is cooperated with a first light source holder. For example, at least one extension, extending from proximate a first end of the light source, may be cooperated with the first longitudinally extending support, holding the first end of the light source with the ceiling support grid. The light source may be hung from the first longitudinally extending support and a driver may be electrically connected with a power source. The light source may then be pivoted about the first longitudinally extending support and placed substantially within a plane of the ceiling support grid.

A second light source mount may then be cooperated with a second light source holder. For example, a second end or end portion of the light source may then be cooperated with the second longitudinally extending support to hold the light source substantially within a plane of the ceiling support grid. In at least one embodiment, at least one clasp may be rotated and clasped onto an extension, extending from the second longitudinally extending support and thereby hold the light source with the ceiling support grid.

It is to be understood that the longitudinal extending supports and the light source of the present disclosure may have a variety features for mounting and holding the light source with the longitudinal extending supports. For example, the light source and/or longitudinal extending supports may have lamp holders in the form of locking mechanisms, retractable or fixed extensions, clips, clasps, openings or slots, tabs, or other configurations as may become known by persons having ordinary skill in the art upon reading the present disclosure.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims.

The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

The invention claimed is:

1. A lighting system configured to be mounted with a ceiling support grid:

the ceiling support grid comprising at least one rectangular or square grid opening with a first longitudinal flange extending inward from a first side, a second longitudinal flange extending inward from a second side, a third longitudinal flange extending inward from a third side, and a fourth longitudinal flange extending inward from a fourth side, wherein the first flange is parallel with the third flange and the second flange is parallel with the fourth flange;

the lighting system comprising:

a first longitudinally extending support having a first light source holder and a longitudinal extending surface for lying on the first flange of the ceiling support grid;

a second longitudinally extending support having a second light source holder and a longitudinal extending surface for lying on the third flange of the ceiling support grid;

a rectangular or square light source configured to be disposed in the rectangular or square grid opening in the ceiling support grid, the light source having a first end and a second end parallel with the first end, the light source comprising:

a first light source mount proximate the first end of the light source configured and disposed to cooperate with the first light source holder, upon the first longitudinally extending support being laid on the first flange of the ceiling support grid;

a second light source mount proximate the second end of the light source configured and disposed to cooperate with the second light source holder, upon the second longitudinally extending support being laid on the third flange of the ceiling support grid;

wherein the cooperation of the first light source holder with the first light source mount and the cooperation of the second light source holder with the second light source mount holds the light source in the ceiling support grid; and wherein the first longitudinally extending support and the second longitudinally extending support are configured to resist rotation upon being laid on the ceiling support grid flanges.

2. The lighting system of claim 1, wherein the first light source holder has at least one opening in the first longitudinally extending support, the second light source holder has at least one extension extending outwardly from the second longitudinally extending support, the first light source mount has at least one extension extending from proximate the first end of the light source configured and disposed to extend into the at least one opening in the first longitudinally extending support, upon the first longitudinally extending support being laid on the first flange of the ceiling support grid, and the second light source mount has at least one clasp proximate the second end of the light source configured and disposed to clasp the at least one extension extending outwardly from the second longitudinally extending support, upon the second longitudinally extending support being laid on the third flange of the ceiling support grid.

3. The lighting system of claim 1, wherein the longitudinal extending surfaces of the longitudinally extending supports for lying on the flanges of the ceiling support grid are flat surfaces.

4. The lighting system of claim 1, wherein first longitudinally extending support is longer than the first end of the light source and second longitudinally extending support is longer than the second end of the light source.

5. The lighting system of claim 1 further comprising at least one anti-rotational stopper on at least one of the longitudinally extending supports.

6. The lighting system of claim 5 wherein the at least one anti-rotational stopper is configured and disposed to cooperate with the second flange or the fourth flange of the ceiling support grid.

7. The lighting system of claim 1 wherein the first and the second longitudinally extending supports have a rectangular or square cross-section.

8. The lighting system of claim 1 further comprising at least one magnet on at least one of the first and the second longitudinally extending supports, the at least one magnet being configured and disposed to magnetically interact with the ceiling support grid, upon the at least one of the first and the second longitudinally extending support being laid on the ceiling support grid.

9. The lighting system of claim 8, wherein the at least one magnet extends vertically from the longitudinal extending surface of the longitudinally extending support.

10. The lighting system of claim 1 being configured to retrofit an existing troffer light source, wherein the first longitudinally extending support is configured to fit between the existing troffer being retrofitted and the first flange of the ceiling support grid and the second longitudinally extending support is configured to fit between the existing troffer being retrofitted and the third flange of ceiling support grid.

11. A lighting system configured to be mounted with a ceiling support grid:

the ceiling support grid comprising at least one rectangular or square grid opening with a first longitudinal flange extending inward from a first side, a second longitudinal flange extending inward from a second side, a third longitudinal flange extending inward from a third side, and a fourth longitudinal flange extending inward from a fourth side, wherein the first flange is parallel with the third flange and the second flange is parallel with the fourth flange;

the lighting system comprising:

a first longitudinally extending support having a flat longitudinal extending surface for lying on the first flange of the ceiling support grid and a portion extending substantially perpendicular to the surface for lying on the first flange with at least one opening therein;

a second longitudinally extending support having a flat longitudinal extending surface for lying on the third flange of the ceiling support grid and a portion extending substantially perpendicular to the surface for lying on the third flange at least one extension extending outwardly from the second longitudinally extending support;

a rectangular or square light source configured to be disposed in the rectangular or square grid opening in the ceiling support grid, the light source having a first end and a second end parallel with the first end;

at least one extension extending from proximate the first end of the light source configured and disposed to extend into the at least one opening in the first longitudinally extending support, upon the first longitudinally extending support being laid on the first flange of the ceiling support grid; and at least one clasp proximate the second end of the light source configured and disposed to clasp the at least one extension extending outwardly from the second longitudinally extending support, upon the second longitudinally extending support being laid on the third flange of the ceiling support grid.

12. The lighting system of claim 11, wherein first longitudinally extending support is longer than the first end of the light source and second longitudinally extending support is longer than the second end of the light source.

13. The lighting system of claim 11 further comprising at least one anti-rotational stopper on at least one of the longitudinally extending supports, wherein the at least one anti-rotational stopper is configured and disposed to cooperate with the second flange or the fourth flange of the ceiling support grid.

14. The lighting system of claim 13, wherein the at least one anti-rotational stopper extends from a terminal end of the longitudinally extending support.

15. The lighting system of claim 11 further comprising at least one magnet on at least one of the first and the second longitudinally extending supports, the at least one magnet being configured and disposed to magnetically interact with the ceiling support grid, upon the at least one of the first and the second longitudinally extending support being laid on the ceiling support grid.

16. The lighting system of claim 15, wherein the at least one magnet extends vertically from the longitudinal extending surface of the longitudinally extending support.

17. The lighting system of claim 11 further comprising an electrical driver for energizing the light source.

18. The lighting system of claim 17, wherein the electrical driver is configured to be magnetically mounted proximate or with the light source.

19. The lighting system of claim 11 being configured to retrofit an existing troffer light source, wherein the first longitudinally extending support is configured to fit between the existing troffer being retrofitted and the first flange of the ceiling support grid and the second longitudinally extending support is configured to fit between the existing troffer being retrofitted and the third flange of ceiling support grid.

20. The lighting system of claim 11 being configured to tool-lessly mounted the light source with the ceiling support grid.

* * * * *